US007478502B2

(12) United States Patent
Bienick et al.

(10) Patent No.: US 7,478,502 B2
(45) **Date of Patent: *Jan. 20, 2009**

(54) APPLIANCE DOORS

(75) Inventors: Craig Bienick, Jenison, MI (US); Howard Daley, Zeeland, MI (US)

(73) Assignee: Gemtron Corporation, Sweetwater, TN (US)

( * ) Notice: Subject to any disclaimer, the term of this patent is extended or adjusted under 35 U.S.C. 154(b) by 616 days.

This patent is subject to a terminal disclaimer.

(21) Appl. No.: 10/640,025

(22) Filed: Aug. 14, 2003

(65) Prior Publication Data

US 2005/0034486 A1 Feb. 17, 2005

(51) Int. Cl.
*E06B 1/04* (2006.01)

(52) U.S. Cl. ..... 52/205; 52/19

(58) Field of Classification Search ..... 68/196, 68/3 R; 52/205, 19, 204.593; 49/501
See application file for complete search history.

(56) References Cited

U.S. PATENT DOCUMENTS

| | | | | |
|---|---|---|---|---|
| RE19,752 | E | 11/1935 | Glasser | |
| 2,140,433 | A | 12/1938 | Paul | |
| 2,383,691 | A * | 8/1945 | Smith | 52/204.593 |
| 2,394,176 | A | 2/1946 | Hillebrand | |
| 2,580,957 | A | 1/1952 | Reeves | |
| 2,650,490 | A | 9/1953 | Glassey | |
| 3,276,229 | A | 10/1966 | Diess | |
| 3,367,730 | A | 2/1968 | Andrews et al. | |
| 3,384,072 | A | 5/1968 | Davis et al. | |
| 3,489,135 | A | 1/1970 | Astrella | |
| 3,877,460 | A | 4/1975 | Lotz et al. | |
| 4,033,322 | A | 7/1977 | Seidel | |
| 4,364,533 | A | 12/1982 | Pompei et al. | |
| 4,403,128 | A | 9/1983 | Takagi et al. | |
| 4,522,311 | A | 6/1985 | Ikeda | |
| 4,892,085 | A | 1/1990 | Salvi | |
| 4,934,559 | A | 6/1990 | Putnam | |
| 5,022,380 | A | 6/1991 | Faurel et al. | |
| 5,496,104 | A | 3/1996 | Arnold et al. | |
| 5,570,597 | A | 11/1996 | Bongini et al. | |
| 5,881,710 | A | 3/1999 | Davis et al. | |
| 6,055,783 | A * | 5/2000 | Guhl et al. | 52/204.62 |
| 6,135,130 | A | 10/2000 | Martineau | |
| 6,228,290 | B1 * | 5/2001 | Reames et al. | 264/1.7 |
| 6,256,823 | B1 | 7/2001 | Kronbetter et al. | |

(Continued)

FOREIGN PATENT DOCUMENTS

| | | |
|---|---|---|
| GB | 2 118 580 A | 11/1983 |

(Continued)

*Primary Examiner*—Richard E Chilcot, Jr.
*Assistant Examiner*—Jessica Laux
(74) *Attorney, Agent, or Firm*—Diller, Ramik & Wight

(57) ABSTRACT

A structural panel, such as an appliance door, includes first and second frame members each having inner and outer peripheral edges with the inner peripheral edges each defining an opening. At least one of the frames is constructed from synthetic polymeric/copolymeric material. A glass panel has an outer peripheral edge in sandwiched relationship with at least one annular member inner peripheral edge thereby closing the opening thereof, and the two frames are secured together. A second glass panel can be associated with the other frame to close the opening therein, and the glass panels can be in spaced parallel relationship to each other. Alternatively, one of the glass panels can be of a concavo/convex relationship, particularly when the structural panel is a washing machine door.

15 Claims, 7 Drawing Sheets

U.S. PATENT DOCUMENTS

| | | | | |
|---|---|---|---|---|
| 6,442,981 | B1 | 9/2002 | Augustsson | |
| 6,508,085 | B1 | 1/2003 | Byrne | |
| 6,539,753 | B1 | 4/2003 | Ito et al. | |
| 6,748,771 | B2 * | 6/2004 | Nitschmann et al. | 68/3 R |
| 6,837,022 | B2 * | 1/2005 | Ito | 52/786.12 |
| 6,966,204 | B2 * | 11/2005 | Bollmann | 68/196 |
| 7,062,889 | B2 * | 6/2006 | Bienick et al. | 52/784.1 |
| 2003/0046964 | A1 | 3/2003 | Bollmann | |
| 2004/0020246 | A1 * | 2/2004 | Yun et al. | 68/24 |
| 2004/0083769 | A1 * | 5/2004 | Kim et al. | 68/12.02 |
| 2005/0050925 | A1 * | 3/2005 | Je et al. | 68/3 R |
| 2006/0156767 | A1 * | 7/2006 | Kim et al. | 68/175 |

FOREIGN PATENT DOCUMENTS

| | | |
|---|---|---|
| GB | 2 294 698 A | 5/1996 |

* cited by examiner

FIG.8
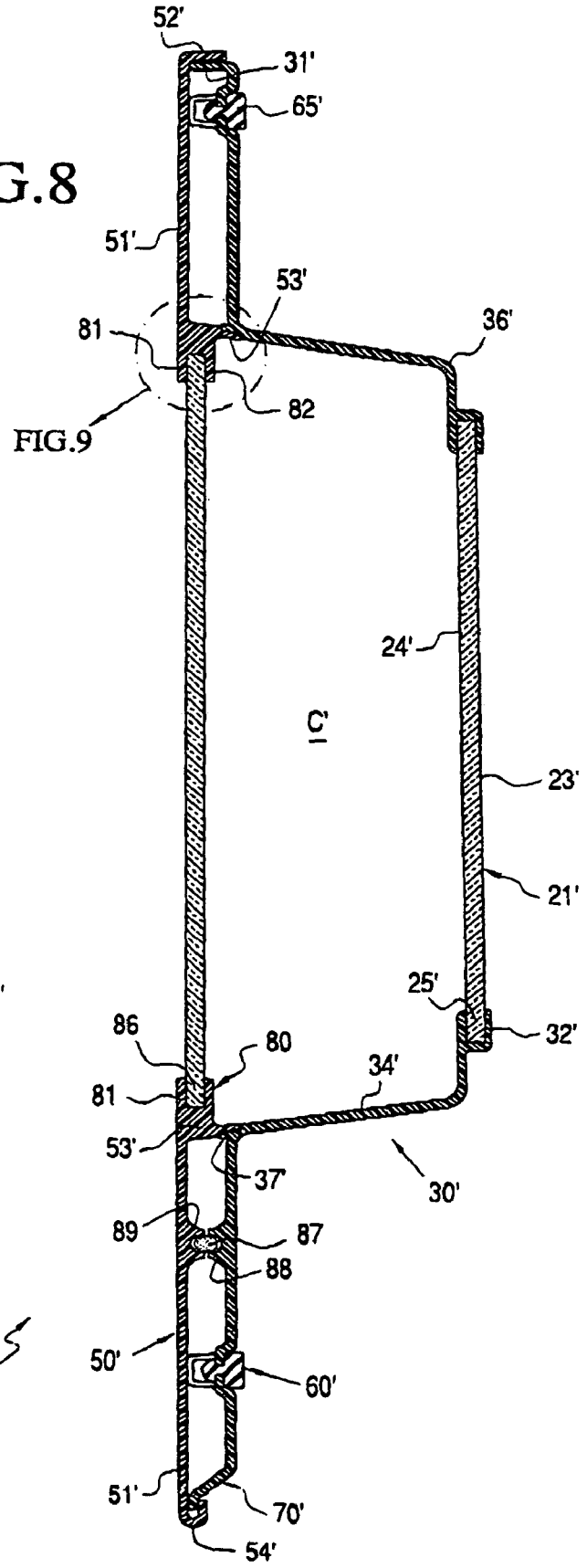
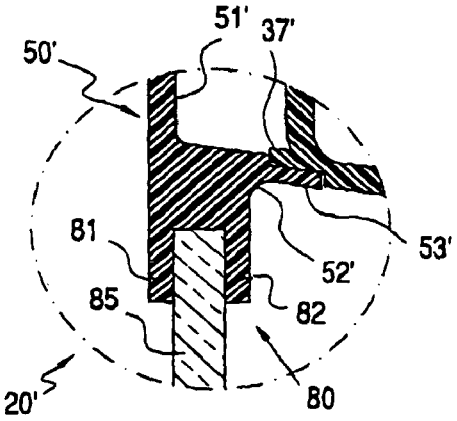
FIG.9

FIG.10
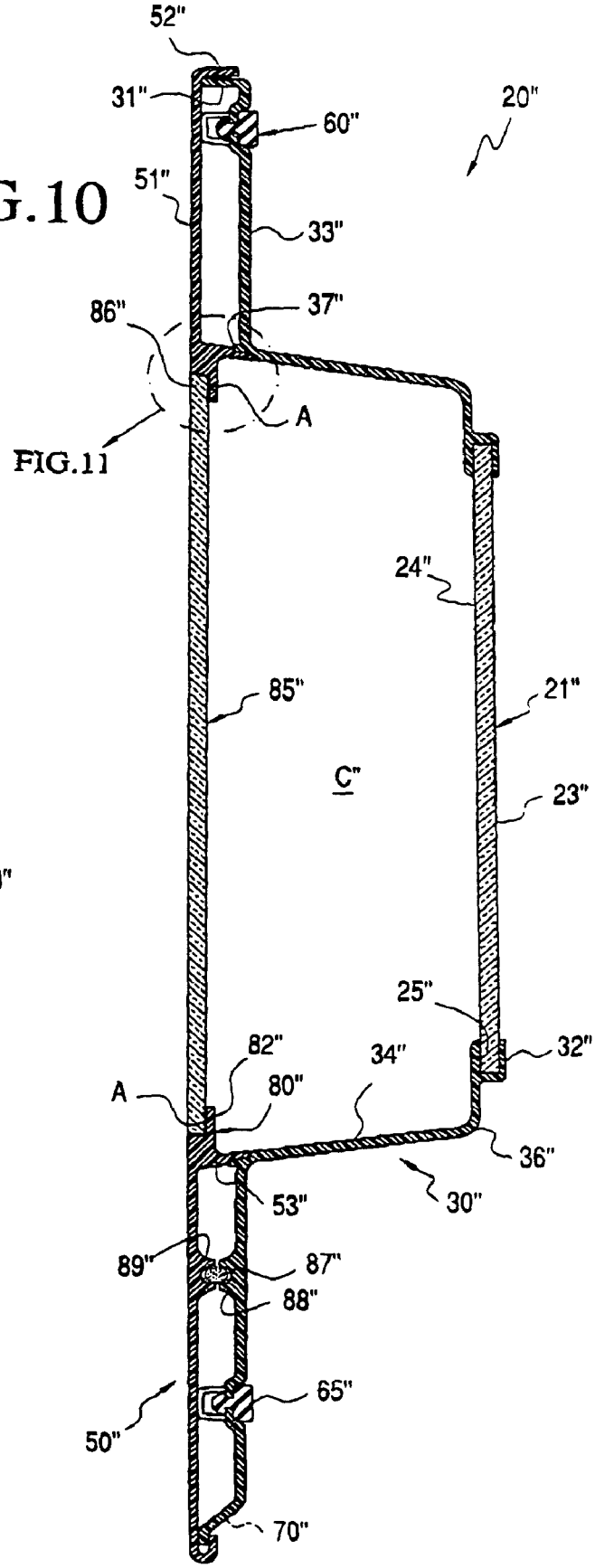
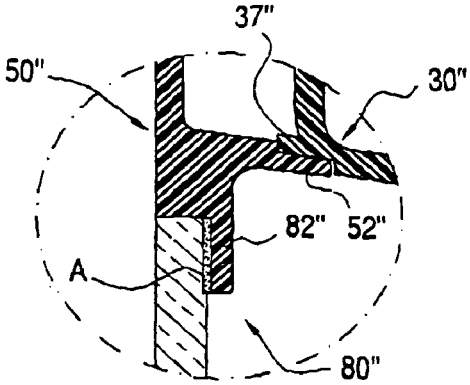
FIG.11

APPLIANCE DOORS

BACKGROUND OF THE INVENTION

The invention is directed to a door or lid for appliances, particularly for "white" goods, such as washers, but can also be utilized in conjunction with dryers or with "brown" appliances, such as a microwave ovens. Conventionally, washer doors have been made of metal with or without a glass panel through which the interior of the washer and its contents can be viewed.

DESCRIPTION OF THE RELATED ART

UK Patent Application GB 2 118 580 describes conventional washer doors for washing machines which each include a piece of glass secured to a circumferential annular support formed of nesting sections by means of screws. In such conventional constructions, it is found very difficult to secure the glass to the annular support by means of separate support sections because the edge of the glass is very often irregular and cannot therefore be fitted correctly to the support. In order to avoid the latter and other problems, an annular support for the glass window of the washing machine door is formed of two complementary annular rings or frames which nest together and have two inboardmost flanges or opposing portions between which the circumferential outer edge of the glass is secured after the two rings have been joined together. The rings are joined together by peripherally innermost and outermost beads, projections or ribs which interconnect with grooves or ribs. Therefore, the washing machine door is essentially constructed from two separate annular rings and a piece of glass which are snap-secured to each other.

UK Patent Application GB 2 294 698 A acknowledges the existence in the prior art of a clothes washing machine door which includes two plastic rings but these are completely absent in the latter disclosure and instead the washer door is defined by a central wall member to which is glued a hinge and a catch. Since the entire door is made from transparent material, a layer of opaque material is applied to the part of the wall member to which the hinge and catch are attached in order to prevent the latter components from being viewed from the exterior.

U.S. Pat. No. 6,539,753 B1 discloses a drum-type washing machine having a cabinet with a front circular access opening which is accessible by opening a door of a circular shape which has a central transparent portion made of glass, for example. The specifics of the construction of the door are only illustrated schematically and are not described.

U.S. Patent Application Publication No. 2003/0046964 A1 discloses a conventional door having a transparent cover, most likely plastic, which is secured by a snap-assembly to a front frame and a gallows frame which allows viewing the washer interior. This might be a representative example of the schematically illustrated door of U.S. Pat. No. 6,539,753 B1.

U.S. Pat. No. 3,276,229 is an example of a relatively old washer door having a sleeve-like peripheral window portion with an edge of a glass panel being secured to a metallic door structure. Metal washer doors with glass windows made from enumerable metallic components screwed or bolted together remain commonplace in the industry and share many of the same disadvantages, most notable among which are the high cost of manufacturing and inevitable rusting and attendant leakage when in use.

U.S. Pat. No. 6,256,823 B1 discloses a door of a front-loading washing machine which has an annular front and an inwardly or rearwardly sloping back of lesser diameter and, on some models, a transparent window to allow the user to view the washing operation. The patent discloses but does not describe a peripheral interconnection between an edge of the transparent window and an unnumbered C-shaped channel in an inboard edge of a sloping back of the door.

U.S. Pat. Nos. 2,394,176 and 3,489,135 are each directed to an oven door construction but are included herein as exemplary of many door constructions utilizing two glass panels.

U.S. Pat. No. 4,934,559 discloses a clothes dryer having a front-loading glass door including a window united to a ring using a door glass seal or gasket.

A number of other patents developed during a search of the present invention are listed herein as reflective of the state of the art.

| Re 19,752 | Glasser |
|---|---|
| 2,140,433 | Paul |
| 2,580,957 | Reeves |
| 2,650,490 | Glassey |
| 3,367,730 | Andrews et al. |
| 3,384,072 | Davis et al. |
| 3,877,460 | Lotz et al. |
| 4,033,322 | Seidel |
| 4,364,533 | Pompei et al. |
| 4,403,128 | Takagi et al. |
| 4,522,311 | Ikeda |
| 4,892,085 | Salvi |
| 5,022,380 | Faurel et al. |
| 5,496,104 | Arnold et al. |
| 5,570,597 | Bongini et al. |
| 5,881,710 | Davis et al. |
| 6,135,130 | Martineau |
| 6,442,981 B1 | Augustsson |
| 6,508,085 B1 | Byrne |

SUMMARY OF THE INVENTION

The present invention is specifically directed to a clothes washer door for a clothes washer, but contrary to the latter-described conventional doors and those of the listed patents, the washer door of the present invention includes a transparent panel constructed from tempered glass and an open frame, border or encapsulation constructed of polymeric/copolymeric synthetic plastic material. An outer peripheral edge of the tempered glass has injection molded thereto an innermost edge of the frame, border or encapsulation and a peripheral flange of the frame is provided with an appropriate hinge, catch and peripheral seal. A second outermost frame is secured in overlying relationship to the flange of the inner frame which effects an aesthetically pleasing outer appearance of the washer door. The two frames are preferably each made of polymeric/copolymeric plastic material and are preferably snap-secured together, but the outer frame can also be made of sheet metal or the like and can be secured to the inner frame by conventional fasteners, such as screws, bolts and nuts, etc.

The washer door, particularly when constructed from two polymeric/copolymeric frames or borders with the tempered glass encapsulated thereto, results in a virtually indestructible washer door which is leak-proof, rust-proof, effects low maintenance, is virtually indestructible, and achieves exceptionable aesthetics at modest costs.

In further accordance with the present invention, the washer door may be provided with a second glass panel carried by the outermost frame which is preferably united thereto through an injection molded peripheral edge encapsulation. In this case, the inner frame and its glass panel and the outer frame and its glass panel are each a unitary structure which can be readily, rapidly and inexpensively secured to each other and disassembled should such be required for purposes of gasket and/or desiccant replacement.

In further accordance with this invention, a washer door may also be constructed from an inner frame and an outer frame with the inner frame having encapsulated thereto an edge of a concavo/convex piece or panel of glass while the outer frame has an inner flange to which is glued an edge of a planar piece of glass. The concavo/convex glass not only affords visual access to the washer interior, but affords tumbling action to the clothing as it is being washed.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 8 is an enlarged cross-sectional view taken generally along line 8-8 of FIG. 7, and illustrates inner and outer frames of the washer door snap-secured to each other with each frame having an innermost peripheral edge encapsulated through injection molding to an associated peripheral edge of a tempered glass panel.

FIG. 9 is an enlarged fragmentary view of the encircled portion of FIG. 8, and illustrates details thereof.

FIG. 10 is a cross-sectional view through another washer door of the present invention similar to FIG. 8, but illustrates an outer frame to which a tempered glass panel is bonded.

FIG. 11 is a fragmentary enlarged view of the encircled portion of FIG. 10, and illustrates details thereof.

DETAILED DESCRIPTION OF THE PREFERRED EMBODIMENTS

Figure 1:
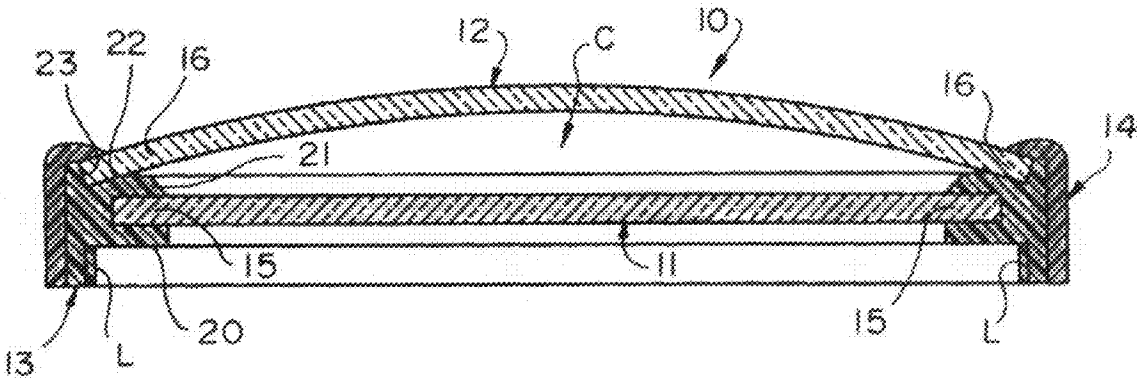
FIG. 1 is a fragmentary front perspective view, and illustrates a clothes washer having an opening closed by a washer door or lid of the present invention hinged thereto with an outer frame defining an opening through which clothing in the washer can be viewed through a tempered glass panel peripherally encapsulated to an inner periphery of a polymeric/copolymeric plastic material inner frame.

A washer 10 is illustrated in FIG. 1 of the drawings and includes a conventional washer body 11 having an interior tub or chamber 12 to which is hinged by a pair of conventional hinges 14 a novel clothes washer door or lid 20 of the present invention. A conventional agitator (not shown) is mounted in the tub or chamber 12 and reciprocates arcuately in a conventional fashion during a clothes washing cycle.

The washer door 20 includes three major components, namely, a tempered glass panel 21, an inner frame, encapsulation or border 30 and an outer frame, encapsulation or border 50.

Figure 3:
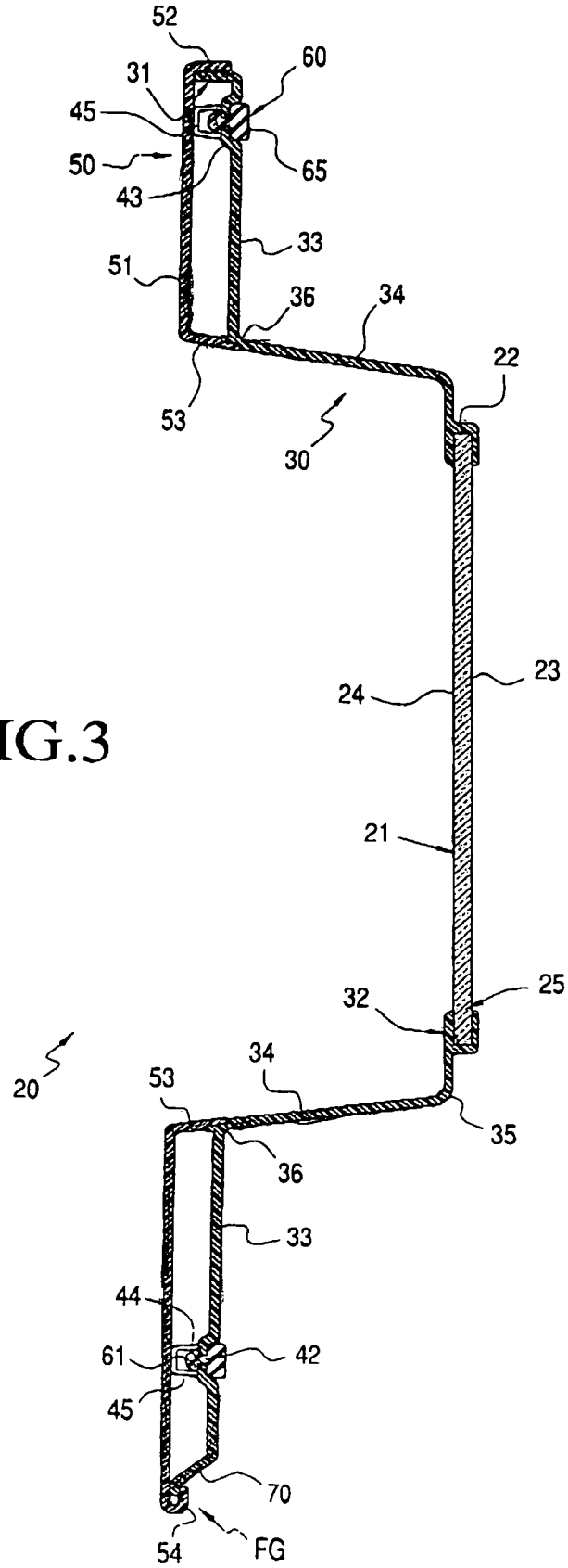
FIG. 3 is an enlarged cross-sectional view taken generally along line 3-3 of FIG. 1, and illustrates the relationship of the inner and outer frames to each other and the assembly thereof.
Figure 4:
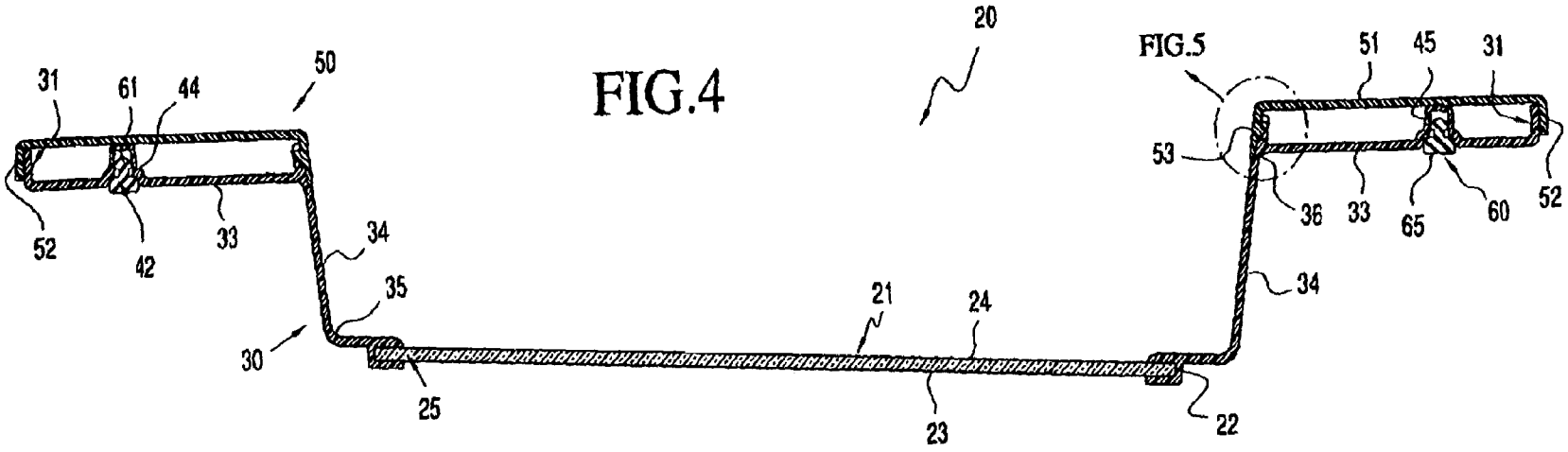
FIG. 4 is a cross-sectional view taken generally along line 4-4 of FIG. 3, and illustrates hooks and slots carried by respective inboard walls of the outer and inner frames for snap-securing the same together.

The tempered glass panel 21 is of a predetermined peripheral configuration defined by a substantially continuous peripheral edge 22. The glass panel 21 further includes opposite inner and outer surfaces 23, 24, respectively, bridged by the peripheral edge 22 (FIGS. 3 and 4). An outermost peripheral edge portion 25 of the piece of glass or glass panel 21 is defined by the peripheral edge 22 and immediately adjacent surface portions (unnumbered) of the opposite inner outer surfaces 23, 24, respectively.

The inner open frame, encapsulation or border 30 is formed as a one-piece, injection molded, polymeric/copolymeric synthetic plastic material annular member and includes an outer peripheral portion, peripheral skirt or peripheral wall 31, an innermost portion 32 entirely encapsulating the outer peripheral edge portion 25 of the glass panel 21, an outermost peripheral flange 33 and a peripheral body wall 34. The peripheral body wall 34 blends with the inner peripheral portion 32 at a radius portion or radius wall 35 and similarly blends or merges with the peripheral flange 33 at a peripheral radius portion or radius wall 36.

Figure 2:
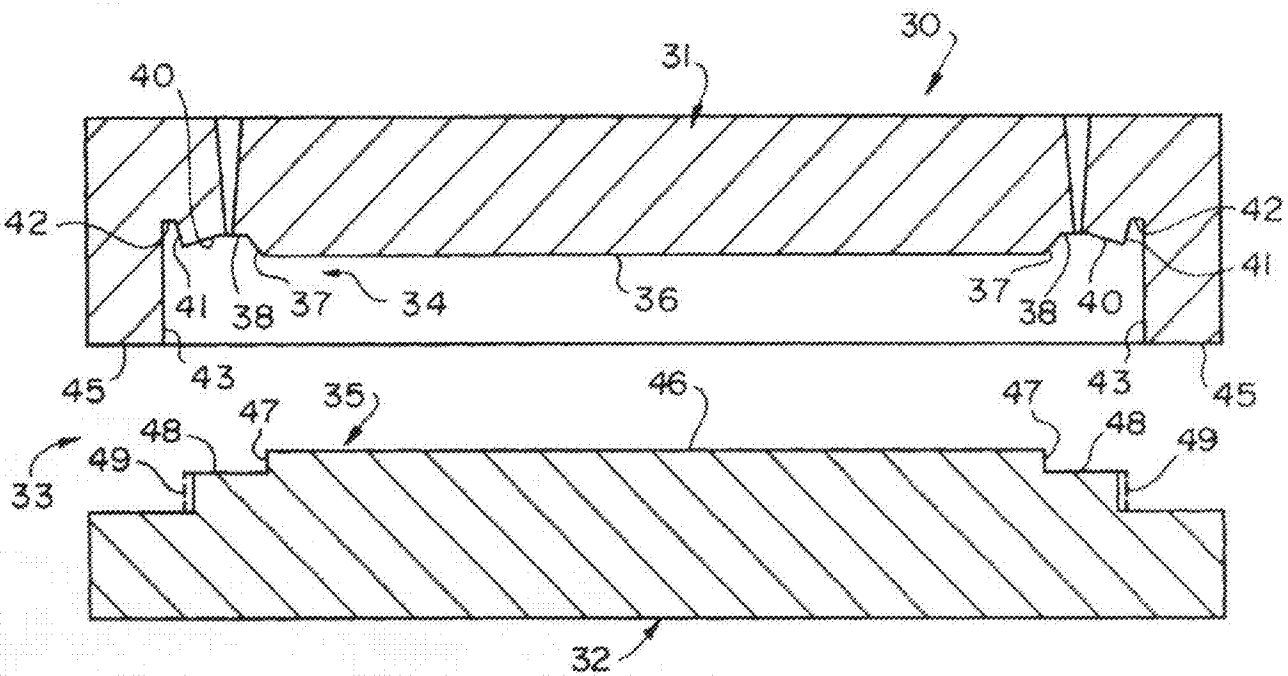
FIG. 2 is an exploded view, and illustrates the inner and outer frames and a gasket prior to the assembly thereof.
Figure 6:
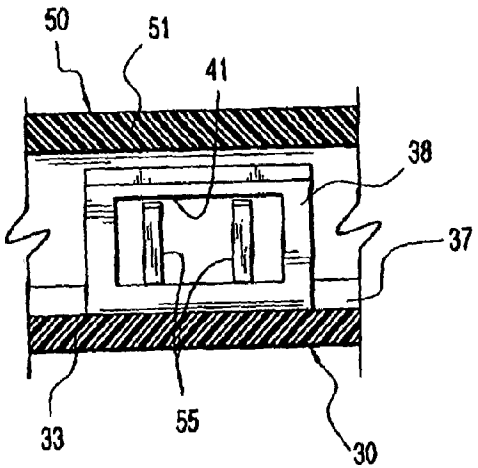
FIG. 6 is a fragmentary cross-sectional view taken generally along line 6-6 of FIG. 5, and illustrates details of the interlocked connection between the pair of hooks or tongues and the associated slot.

An axially outwardly projecting peripheral wall 37 (FIGS. 3-5) is an extension of the body wall 34 and projects axially outwardly beyond the peripheral flange 33 and substantially normal thereto (FIG. 5), and projecting therefrom in peripherally spaced relationship to each other are a plurality of identical latching or securing tabs or fingers 38 (FIGS. 2, 5 and 6) each having a generally polygonal latching opening, slot or aperture 41 therein. The peripheral flange 33 of the frame or annular member 30 includes an inwardly opening substantially continuous channel 42 (FIG. 3) defined by a generally inwardly opening U-shaped wall 43 provided along its bottom (unnumbered) with a plurality of spaced slots 44 (FIG. 2) and between adjacent slots 44 are inwardly opening generally U-shaped wall portions 45 (FIG. 2). A sealing gasket 60 (FIG. 2) corresponding to the configuration of the channel 42 is seated in the latter with portions 61 of the sealing gasket 60 being forced through the slots 44 to thereby retain the sealing gasket 60 seated within the channel 42 with a gasket sealing surface 65 of the sealing gasket 60 positioned to peripherally contact and seal against an outer surface (unnumbered) of the washer body 11 in the closed position of the washer door 20 (FIG. 1) to prevent leakage of water during a washing cycle.

The peripheral skirt or peripheral wall 31 of the inner frame 30 is disposed substantially normal to the peripheral flange 33 along the upper and side edges (unnumbered in FIG. 1) of the door 20, as is designated appropriately by the reference numeral 69 in FIGS. 1 and 2, but at the bottom edge a portion 70 (FIGS. 2 and 3) of the peripheral wall 31 tapers upwardly at an approximately 45 degree angle and outwardly therefrom.

The outer frame or annular member 50 includes an annular wall 51, an outer peripheral wall 52 and an inner peripheral wall 53. The outer peripheral wall 52 is substantially normal to the annular wall 51 along the upper and side edges (unnumbered) of the door 20 but at the bottom edge a wall portion 54 (FIG. 3) is formed into an inwardly opening hook which engages the bottom wall portion 70 (FIG. 3) of the inner frame 30 and defines therewith a finger grip area FG (FIG. 3) running along the bottom of the door 20 which can be gripped by a user to open and close the door 20. The inner peripheral wall 53 of the outer frame 50 includes eight pairs of latching teeth, tabs or tongues 55 (FIGS. 5 and 6) which engage by pairs in each of the polygonal latching openings 41 of the inner frame member 30 in the manner best illustrated in FIGS. 5 and 6 of the drawings to maintain the inner and outer frames 30, 50, respectively, in snap-secured assembled relationship. Preferably, the walls 37, 53 (FIG. 5) of the respective inner and outer frames 30, 50 are stepped to provide a smooth transition between the outer surfaces (unnumbered) of the peripheral body wall 34 of the inner frame 30 and the inner peripheral wall 53 of the outer frame 50. Since the material of the outer frame 50 is preferably relatively resilient polymeric/copolymeric material, but can also be sheet metal, a tool, such as the blade B (FIG. 5) of a screwdriver, can be inserted at the juncture (unnumbered) of the walls 34, 53 of the respective inner and outer frames 30, 50 to flex or bend the inner peripheral wall 53 sufficiently to progressively disengage the pairs of tongues or notches 55 from the grooves 41 to disassemble the frames 30, 50, as may be necessary to repair/replace the gasket 60. Furthermore, the annular wall 51 of the outer frame 50 rests upon the U-shaped wall portions or channels 45 and is supported thereby to impart further rigidity/integrity to the overall washer door 20.

Figure 7:
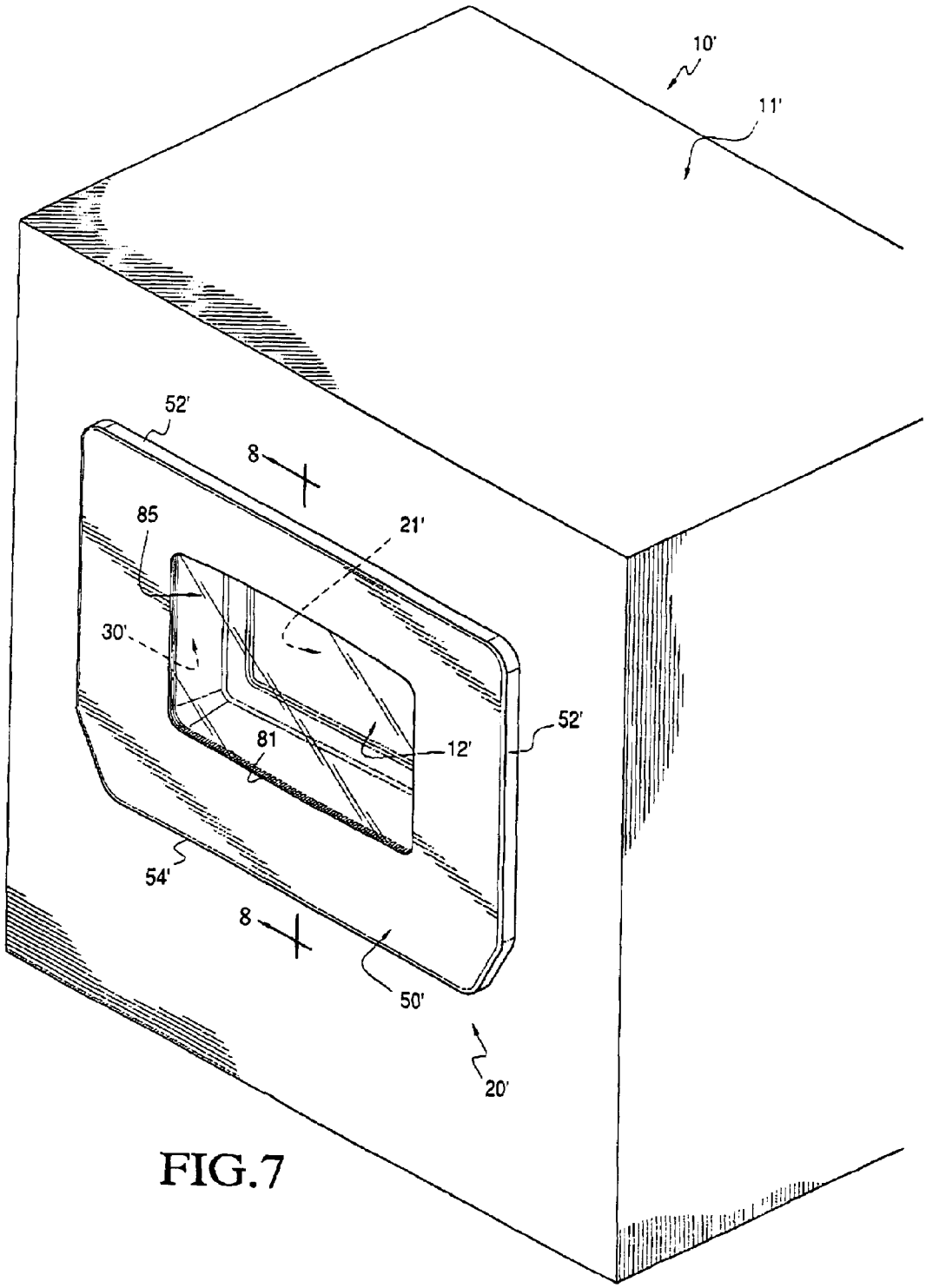
FIG. 7 is a fragmentary perspective view of another clothes washer, and illustrates another door of the invention in its closed position.

Reference is made to FIGS. 7 through 9 of the drawings and another washer 10' (FIG. 7) which includes a conventional washer body 11' having an interior tub or chamber 12' and a washer door or lid 20'. All structure of the washer 10' which is identical to structure of the washer 10 has been primed to thereby incorporate by reference such identical structure into the description of the washer 10' and washer door 20' thereof.

Figure 5:
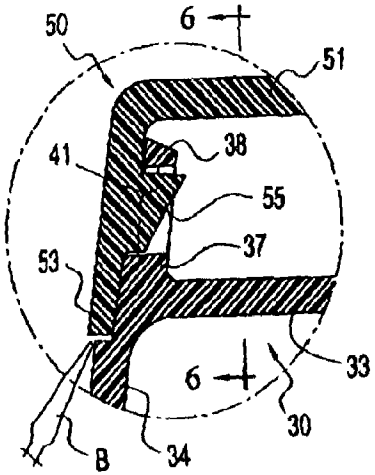
FIG. 5 is an enlarged fragmentary view of the encircled portion of FIG. 4, and illustrates a pair of hooks or tongues of an inner wall of the outer frame received in a slot of an inner wall of the inner frame.

The washer door 20' includes three major components, namely, a tempered glass panel 21', an inner frame, encapsulation or border 30', and an outer frame, border, annular member or encapsulation 50'. The outer frame 50' includes an annular flange 51', an outer peripheral flange or skirt 52' and an inner peripheral wall 53' (FIG. 9). The inner peripheral wall 53' is snap-secured to the inner peripheral wall 37' (not shown) of the inner frame 30' by pairs of latching tongues or tabs and polygonal openings (not shown for purposes of clarity) corresponding to the respective tongues and openings 55, 41, respectively, of the washer door 20 (FIG. 5). However, the outer frame 50' is formed as an integral injection-molded encapsulation of synthetic polymeric/copolymeric plastic material and includes a peripheral encapsulation edge 80 which includes outer and inner peripheral walls 81, 82, respectively, between which is encapsulated an outermost peripheral edge 86 of a piece or panel of tempered glass 85 which with the glass panel 21', the body wall 34' and the radius 36' define a cavity or chamber C' (FIG. 8) through which the interior of the washer tub or chamber 12' and the clothing therein can be viewed.

In order to preclude the interior surfaces (unnumbered) of the glass panels 21', 85 from becoming fogged-up when in use, a peripheral annular band 87 of desiccant material somewhat in the shape of a large O-ring, is held in sandwiched relationship between opposing grooves (unnumbered) formed in opposing circumferential projections 88, 89 integrally formed upon the injection molding of the inner frame 30' and the outer frame 50', respectively. Any moist air within the chamber C' readily migrates through gaps or spaces between the peripheral walls 37', 53' (FIG. 9) and the respective latching openings and tabs (not shown) associated therewith corresponding to the structure shown in FIG. 5. If found necessary or desirable, additional air passage openings can be formed in the peripheral walls 37', 53' of the respective inner and outer frames 30', 50' to afford air passage. The O-shaped ring or band 87 of desiccant can also be snapped-fit or adhesively bonded to either or both of the channels (unnumbered) of the projections 88, 89.

Reference is made to FIGS. 10 and 11 of the drawings and another washer door or lid 20" constructed in accordance with this invention. All structure of the washer door 20" which is identical to the washer doors 20, 20' has been double primed to thereby incorporate by reference such identical structure into the description of the washer door 20".

The washer door 20" includes three major components, namely, a tempered glass panel 21", an inner frame, encapsulation or border 30", and an outer frame, border, annular member or encapsulation 50". The outer frame 50" includes an annular flange 51", an outer peripheral wall or skirt 52" and an inner peripheral wall 53" (FIG. 9). The inner peripheral wall 53" is snap-secured to the inner peripheral wall 37" of the inner frame 30" by pairs of latching tongues or tabs and polygonal openings (not shown for purposes of clarity) corresponding to the respective tongues and openings 55, 41, respectively, of the washer door 20 (FIG. 5). However, the outer frame 50" is formed as an integral injection-molded encapsulation of synthetic polymeric/copolymeric plastic material and includes a peripheral encapsulation edge 80" which includes an inner peripheral wall 82" upon which is seated an outermost peripheral edge 86" of a piece or panel of tempered glass 85" which with the glass panel 21", the body wall 34" and radius 36" define a cavity or chamber C" (FIG. 10) through which the interior of an associated washer tub or chamber and the clothing therein can be viewed.

In order to preclude the interior surfaces (unnumbered) of the glass panels 21", 85" from becoming fogged-up when in use, a peripheral annular band 87" of desiccant material, somewhat in the shape of a large O-ring, is held in sandwiched relationship between opposing grooves (unnumbered) formed in opposing circumferential projections 88", 89" integrally formed upon the injection molding of the inner frame 30" and the outer frame 50". Any moist air within the chamber C" readily migrates through gaps or spaces between the peripheral walls 37", 53" and the respective latching openings and tabs (not shown) associated therewith corresponding to the structure shown in FIG. 5. If found necessary or desirable, additional air passage openings can be formed in the peripheral walls 37", 53" of the respective inner and outer frames 30", 50" to afford air passage. The O-shaped ring or band 87" of desiccant can also be snapped-fit or adhesively bonded to either or both of the channels (unnumbered) of the projections 88", 89".

Figure 12:
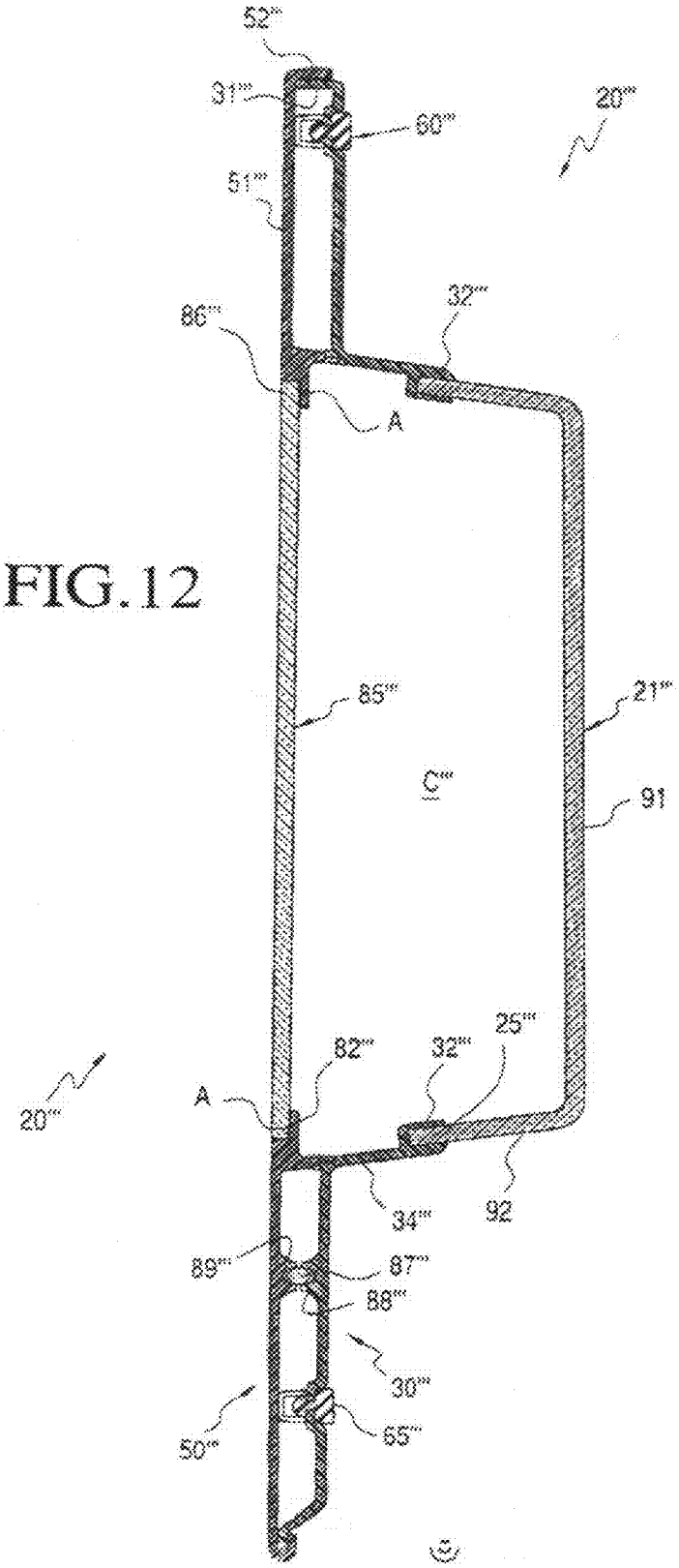
FIG. 12 is a cross-sectional view taken through another washer door of the present invention similar to the washer doors of FIGS. 8 and 10, and illustrates a concavo/convex piece of tempered glass having an edge encapsulated through injection molding to an inner frame of the washer door and an outer planar tempered glass panel bonded to an outer frame of the washer door.

Reference is made to FIG. 12 of the drawings and another washer door or lid 20'" constructed in accordance with this invention. All structure of the washer door 20'" which is identical to the washer doors 20, 20' and 20" has been triple primed to thereby incorporate by reference such identical structure into the description of the washer 20'".

The washer door 20'" includes three major components, namely, a tempered glass panel 21'", an inner frame, encapsulation or border 30''', and an outer frame, border, annular member or encapsulation 50'''. The outer frame 50''' includes an annular flange 51''', an outer peripheral skirt 52''' and an inner peripheral wall 53'''. The inner peripheral wall 53''' is snap-secured to the inner peripheral wall 37''' of the inner frame 30''' by pairs of latching tongues or tabs and polygonal openings (not shown for purposes of clarity) corresponding to the respective tongues and openings 55, 41, respectively, of the washer door 20 (FIG. 5). However, the outer frame 50''' is formed as an integral injection-molded encapsulation of synthetic polymeric/copolymeric plastic material and includes a peripheral edge 80''' which includes an inner peripheral wall 82''' upon which is seated an outermost peripheral edge 86''' of a piece or panel of tempered glass 85''' which with the glass panel 21''' the body wall 34''' and the radius 36''' define a cavity or chamber C''' through which the interior of an associated washer tub or chamber and the clothing therein can be viewed. The piece or panel of tempered glass 21''' is of a cup-shaped configuration defined by a base portion 91 and a peripheral wall 92 which in part defines the chamber C'''. Other than the latter shape of the glass panel 21''' and the absence of a radius or radius portion 36'' (FIG. 10), the washer door 20''' is identical in structure and function to the washer door 20'' of FIGS. 10 and 11.

Each of the washer doors 20 (FIGS. 1 through 7), 20' (FIGS. 8, 9) 20'' (FIGS. 10, 11) and 20''' (FIG. 12) includes in common at least one piece or panel of tempered glass 21, 21', 21'', and 21''' having an outermost peripheral edge 25, 25', 25'' and 25''' encapsulated by a peripheral encapsulating edge portion 32, 32', 32'' and 32''' formed during the injection molding of the inner annular member or frame 30, 30', 30'' and 30'''. Furthermore, though the outer frames or annular members 50, 50', 50'' and 50''' are preferably constructed as integral one-piece injection molded components, the annular members or borders 50 (FIGS. 1 through 7), 50'' and 50''' can be constructed from metallic material, such as sheet metal. In such constructions the tabs or tongues 55 and the openings 41 (FIGS. 5 and 6) blanked, bent and/or struck from the metal can be utilized, or in lieu thereof, conventional fasteners F (FIG. 1), such as screws, can instead or in addition be used to fasten the inner and outer frames or annular members 30, 30'', 30''' and 50, 50'', 50''', respectively, to each other. Appropriate adhesive A is conventionally known for bonding glass to metal as well as to synthetic plastic material. Therefore, depending upon aesthetics, cost, desires of manufacturers and/or end users, the outer annular members or borders 50, 50'' and 50''' can be constructed from sheet metal or similar metallic material, whereas such cannot be done with respect to the outer annular member, border or frame 50' (FIGS. 8 and 9) which, obviously, includes the one-piece injection molded border 50' including the encapsulating edge portion 80 thereof.

Although preferred embodiments of the invention have been specifically illustrated and described herein, it is to be understood that minor variations may be made in the various washer doors without departing from the spirit and scope of the invention, as defined by the appended claims.

What is claimed is:

1. A structural panel defined by first and second substantially annular members and a glass panel, said first substantially annular member including a substantially peripheral wall and a substantially annular flange projecting substantially radially outwardly of said peripheral wall in a plane substantially normal to an axis of said first substantially annular member and terminating at an outermost terminal edge portion, said peripheral wall terminating at an innermost terminal edge portion remote from said outermost terminal end portion, said first substantially annular member being constructed from synthetic polymeric/copolymeric material, said glass panel having an outer peripheral edge, said glass panel outer peripheral edge being sandwiched in in situ molded encapsulated relationship with said peripheral wall innermost terminal edge portion thereby imparting a substantially U-shaped radially outwardly flanged axial cross-sectional configuration to said first substantially annular member, said second substantially annular member being disposed in substantially contiguous overlying parallel relationship to said first member annular flange at a side thereof axially remote from said glass panel, and means for securing said first and second substantially annular members together.

2. The structural panel as defined in claim 1 wherein said first annular member includes a second substantially annular flange remotely spaced from said first-mentioned annular flange projecting substantially radially inwardly of said peripheral wall and terminating at said innermost terminal edge.

3. The structural panel as defined in claim 1 wherein said glass panel includes a central panel portion and a peripheral wall imparting a substantially U-shaped axial cross-sectional configuration to said glass panel, and said glass panel peripheral wall terminates at said glass panel outer peripheral edge.

4. The structural panel as defined in claim 1 including a second glass panel having an outermost terminal edge portion, and means for securing said second glass panel outermost terminal edge portion adjacent a peripheral juncture portion between said first annular member peripheral wall and annular flange.

5. The structural panel as defined in claim 1 including a second glass panel having an outermost terminal edge portion, means for securing said second glass panel outermost terminal edge portion adjacent a peripheral juncture portion between said first annular member peripheral wall and annular flange, and said last-mentioned securing means is defined by an adhesive bond.

6. The structural panel as defined in claim 1 including a second glass panel having an outermost terminal edge portion, means for securing said second glass panel outermost terminal edge portion adjacent a peripheral juncture portion between said first annular member peripheral wall and annular flange, and said last-mentioned securing means is defined by said second glass panel outermost terminal edge portion being in sandwiched in situ encapsulated relationship with an innermost peripheral portion of said second annular member.

7. The structural panel as defined in claim 1 including a second glass panel having an outermost terminal edge portion, means for securing said second glass panel outermost terminal edge portion adjacent a peripheral juncture portion between said first annular member peripheral wall and annular flange, and said last-mentioned securing means is defined by an adhesive bond between said second glass panel outermost terminal edge portion and an innermost peripheral portion of said second annular member.

8. The structural panel as defined in claim 1 wherein said second substantially annular member includes innermost and outermost peripheral portions, and said securing means includes interlocked tongues and openings of said first and second annular members located contiguous an innermost peripheral portion of said second annular member and a peripheral juncture portion between said first annular member peripheral wall and annular flange.

9. The structural panel as defined in claim 1 wherein said second substantially annular member includes innermost and outermost peripheral portions, and said securing means includes hook portions of one of said second annular member innermost and outermost peripheral portions in hooking engagement with one of said first annular member outermost and innermost peripheral portions respectively.

10. The structural panel as defined in claim 1 including an annular member of desiccant material disposed in sandwiched relationship between said first annular member annular flange and said second annular member.

11. The structural panel as defined in claim 1 wherein said second annular member includes innermost and outermost terminal edge portions, and said second annular member innermost terminal edge portion in part defines an innermost peripheral wall of said second annular member substantially coextensively merging with said first annular member peripheral wall.

12. The structural panel as defined in claim 1 wherein said second annular member includes innermost and outermost terminal edge portions, and said second annular member innermost terminal edge portion in part defines an innermost peripheral wall of said second annular member substantially coextensively merging with said first annular member peripheral wall at a peripheral juncture portion thereof defined between said first annular member peripheral wall and annular flange.

13. The structural panel as defined in claim 1 wherein said first annular member includes a peripheral juncture portion defined between said first annular member peripheral wall and annular flange, and inner peripheral step in said peripheral juncture portion, said second annular member including an annular wall and an innermost peripheral wall portion projecting toward said peripheral juncture portion, and said second annular member innermost peripheral wall portion has a terminal edge seated in said inner peripheral step.

14. The structural panel as defined in claim 1 wherein said first annular member includes a peripheral juncture portion defined between said first annular member peripheral wall and annular flange, and inner peripheral step in said peripheral juncture portion, said second annular member including an annular wall and an innermost peripheral wall portion projecting toward said peripheral juncture portion, said second annular member innermost peripheral wall portion has a terminal edge seated in said inner peripheral step, and said securing means is disposed contiguous said second annular member innermost peripheral wall portion sand said first annular member peripheral juncture portion.

15. The structural panel as defined in claim 1 including a second glass panel having an outermost terminal edge portion, and said second substantially annular member having an innermost peripheral portion in in situ encapsulating relationship to said second glass panel outermost terminal edge portion.

* * * * *